United States Patent [19]

Frommherz

[11] Patent Number: 4,632,363

[45] Date of Patent: Dec. 30, 1986

[54] WINCH HAVING A DRIVE DISC CONNECTABLE TO A ROPE DRUM IN DEPENDENCE UPON THE LOAD APPLIED TO THE ROPE

[75] Inventor: Egon Frommherz, Steinen, Fed. Rep. of Germany

[73] Assignee: Rotzler GmbH & Co. Spezialfabrik für Seilwinden und Hebezeuge, Steinen, Fed. Rep. of Germany

[21] Appl. No.: 762,107

[22] Filed: Aug. 2, 1985

[30] Foreign Application Priority Data

Aug. 4, 1984 [DE] Fed. Rep. of Germany ..... 3428875

[51] Int. Cl.[4] ..... B66D 1/14; B66D 1/26

[52] U.S. Cl. ..... 254/309; 254/283; 254/371

[58] Field of Search ..... 254/214, 219, 278, 294, 254/295, 297, 333, 344, 371, 309, 283; 242/47.09, 155 BW

[56] References Cited

U.S. PATENT DOCUMENTS

| | | | |
|---|---|---|---|
| 3,120,043 | 2/1964 | Henley | 254/371 X |
| 3,776,519 | 12/1973 | Hamilton | 254/333 X |
| 3,887,164 | 6/1975 | Coombs | 254/333 X |
| 3,968,953 | 7/1976 | Guangorena | 254/371 X |
| 4,193,311 | 3/1980 | Rinio et al. | 254/371 X |
| 4,225,119 | 9/1980 | Frommherz | 254/294 |

FOREIGN PATENT DOCUMENTS

| | | | |
|---|---|---|---|
| 2517796 | 11/1976 | Fed. Rep. of Germany | 254/278 |
| 1335659 | 10/1973 | United Kingdom | 254/278 |

*Primary Examiner*—Stuart S. Levy
*Assistant Examiner*—Joseph J. Hail, III
*Attorney, Agent, or Firm*—Walter Ottesen

[57] ABSTRACT

A winch is disclosed having at least one rope drum which includes a run-out groove on its periphery in which a rope is guided. The run-out groove is bounded in part by a tightening disc which is pressable against one side of the rope. The run-out groove for the rope is configured on a drive disc which is configured so as to be separate from the rope drum. The drive disc is coupled with the rope drum via a free runner and in such a manner that an operative connection existing when the rope is run out under load is interrupted when the load is removed from the rope.

11 Claims, 5 Drawing Figures

WINCH HAVING A DRIVE DISC CONNECTABLE TO A ROPE DRUM IN DEPENDENCE UPON THE LOAD APPLIED TO THE ROPE

FIELD OF THE INVENTION

The invention relates to a winch with at least one rope drum and a member defining a run-out groove for guiding the rope. The run-out groove is bounded by a tightening disc pressable against the rope.

BACKGROUND OF THE INVENTION

The known winches of this kind are most often equipped with at least two drums arranged so as to be spaced from each other and parallel to each other. A wire rope is slung about the rope drums and is guided in grooves formed on the peripheral surface of the rope drums. Both rope drums are driven by a motor via a corresponding branching gear transmission. One of the two rope drums has a run-out groove for the rope which is bounded by a tightening disc. This tightening disc is configured so that it is pressable against the one side of the rope.

The rope to which the load is attachable, can be run out via the drive motor which most often is configured as an oil motor and by means of corresponding switching of the transmission. If the rope is unloaded so that no load is suspended from the rope, the rope must be pulled out by hand. If this does not happen, the rope runs against a hydraulic contact switch which actuates a hydraulic valve. Hydraulic oil is transmitted into a piston-cylinder displacement unit through the hydraulic valve. The tightening disc is pulled away from the cable rope via the displacement unit whereby the force flow or frictional engagement is interrupted. The hydraulic piston-cylinder displacement unit is most expensive and difficult to produce because tight tolerances and precise workmanship must be maintained.

A further disadvantage is that, for example, because of inadequate sealing in the hydraulic displacement unit, the operational reliability is affected so that a large residual frictional engagement remains in the region of the run-out groove so that this can lead to the undesired formation of loops when the rope is run out. Such a formation of loops can often not be prevented also with respect to a dirty rope because of the frictional engagement conditions utilized in the region of the run-out groove.

SUMMARY OF THE INVENTION

It is an object of the invention to provide a winch which makes it unnecessary to utilize a costly hydraulic displacement unit and to provide a trouble-free run-out of the rope from the winch without the formation of loops dependent upon the tension in the rope.

The winch of the invention includes a frame housing; and, at least one rope drum assembly mounted in the frame housing. The rope drum assembly includes a rope drum rotatably mounted in the housing and defining groove means for guiding a rope thereon; a drive disc disposed adjacent the rope drum and defining a run-out groove for the rope; free runner means for establishing an operative connection between the drive disc and the rope drum when the rope is pulled out under load from the run-out groove and for interrupting the operative connection when the rope becomes unloaded; and, tightening means for pressing against the rope as it is run out from the run-out groove.

Preferred embodiments of the invention as well as the advantages and the essential details thereof are disclosed in the drawing and the description and the claims which follow.

BRIEF DESCRIPTION OF THE DRAWING

The invention will now be described with reference to the drawing wherein.

DESCRIPTION OF THE PREFERRED EMBODIMENTS OF THE INVENTION

Figure 1:
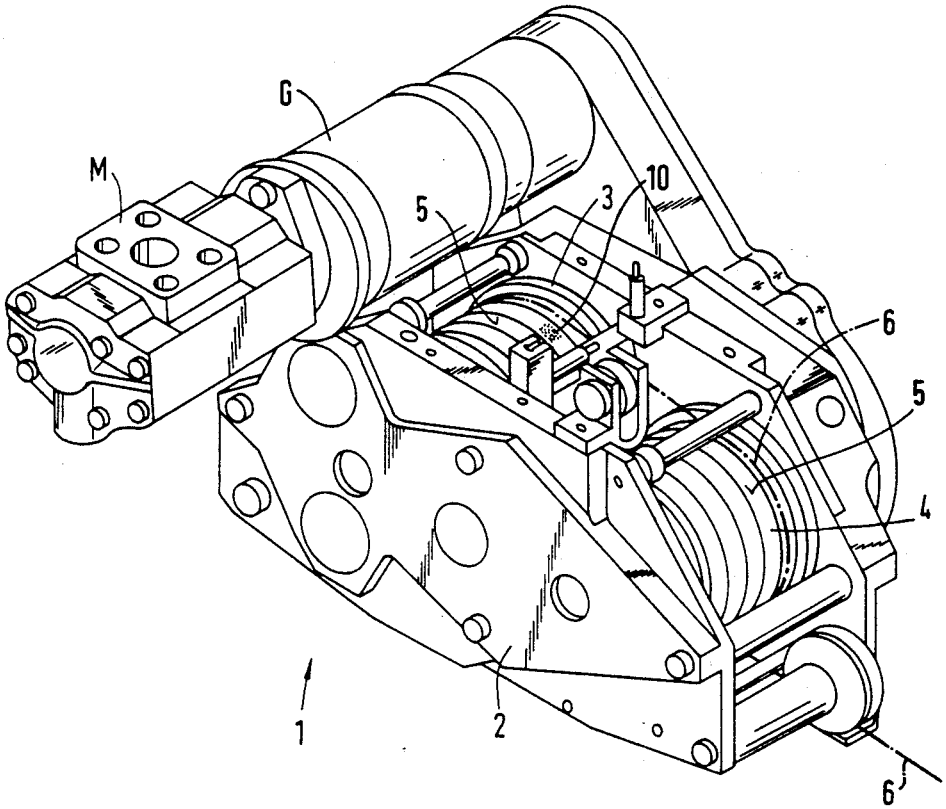
FIG. 1 is a perspective view of the winch according to the invention.
Figure 2:
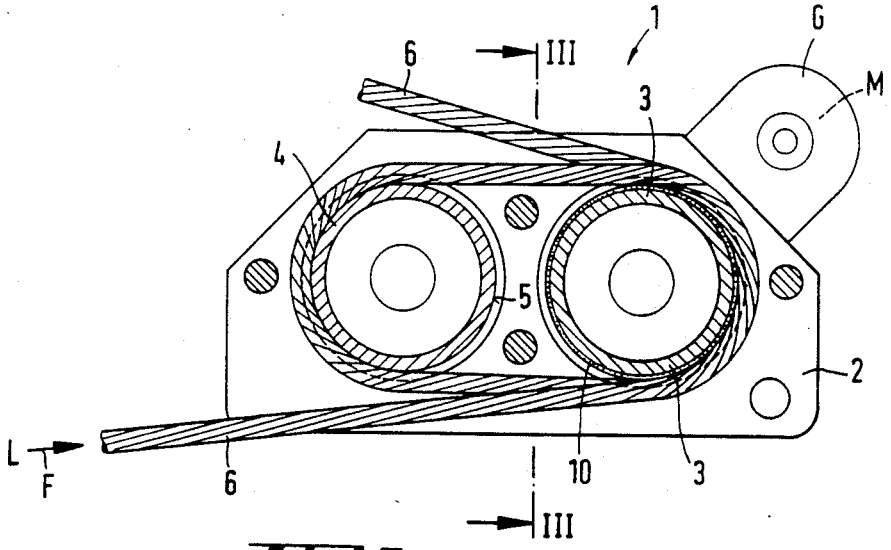
FIG. 2 is a side elevation view, partially in section, of the winch of FIG. 1.
Figure 3:
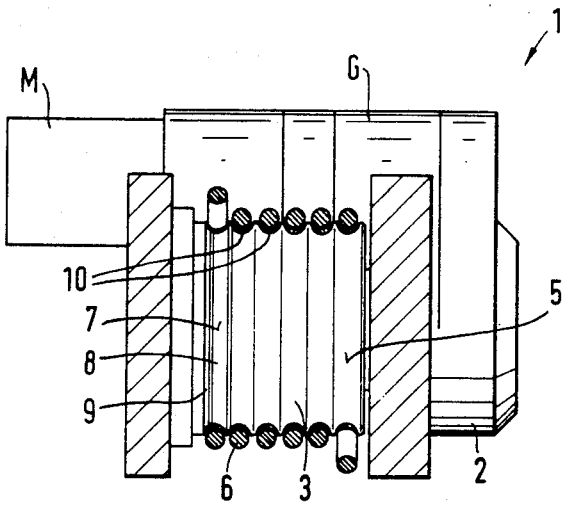
FIG. 3 is a section view taken along lines III—III of FIG. 2.

The winch of FIG. 1 includes a frame housing 2 wherein two rope drums 3, 4 are rotatably journalled and are arranged so as to be mutually parallel and in spaced relationship to each other. The two rope drums 3, 4 are driven via a motor M which is preferably configured as an oil motor. A branching gear transmission G is mounted after the drive motor. The transmission G is preferably configured as a gear wheel transmission for a mecnanically rigid drive connection and both rope drums 3, 4 are moved with the same rotational speed. The rope drums 3, 4 have peripheral grooves 5 in which the rope 6 is guided. A load L (not shown) is attachable to the rope 6 which is slung around both rope drums 3, 4.

If the load L is pulled in as indicated by arrow F, the rope 6 first runs in on the rope drum 3. The rope 6 leaves the rope drum 3 at the other side in the region of a run-out groove 7. The run-out groove 7 is configured on the periphery of a drive disc 8 which is configured to be separate from the rope drum 3 and is, however, journalled thereon. The run-out groove 7 is bounded by a tightening disc 9 which is pressable against the side of the rope 6.

During work with the winch 1, the rope 6 can, for example, become intensely dirtied with mud or the like. When the dirt is deposited in the peripheral grooves 5 when pulling in the rope 6, a change of the diameter of the rope drum occurs. Once a dirt layer 10 builds up in the peripheral grooves 5, different peripheral velocities then occur as a consequence thereof on the rope drums 3, 4 in the region where the rope 6 is slung about the drums, the rope drums 3, 4 being driven at the same rotational speed. In order to compensate for the different conditions in the region of the winch 1 occurring when the rope 6 becomes dirty, it is advantageous to provide a slip clutch for use when pulling in the rope 6. Such a slip clutch can be mounted on either rope drum 3 or rope drum 4 or also on both rope drums 3, 4 and is preferably configured as a laminar coupling. In this connection, reference may be had to my copending application entitled "Winch having a Slip Clutch".

When working in the opposite direction, that is when the rope 6 is run out of the winch 1 and it is desired to make certain that no loops form when the rope tension becomes inadequate, and that, instead, the rope is caused to stop immediately, a free-runner 11 is provided pursuant to the invention on which the drive disc 8 is journalled. The free runner 11 is located on an axial projection 12 of the rope drum 3 and is so configured that an operative connection for an unloaded rope 6 is immediately discontinued, the operative connection existing when the rope 6 is run out under load. The drive disc 8 comes to an immediate standstill when the rope 6 is unloaded since sufficient friction is no longer provided via the free runner 11 for driving the rope drum 3. Only when an adequate tension force acts on rope 6, is the frictive engagement on the free runner 11 so large that the drive disc 8 rotates therewith to run out the rope 6.

Figure 4:
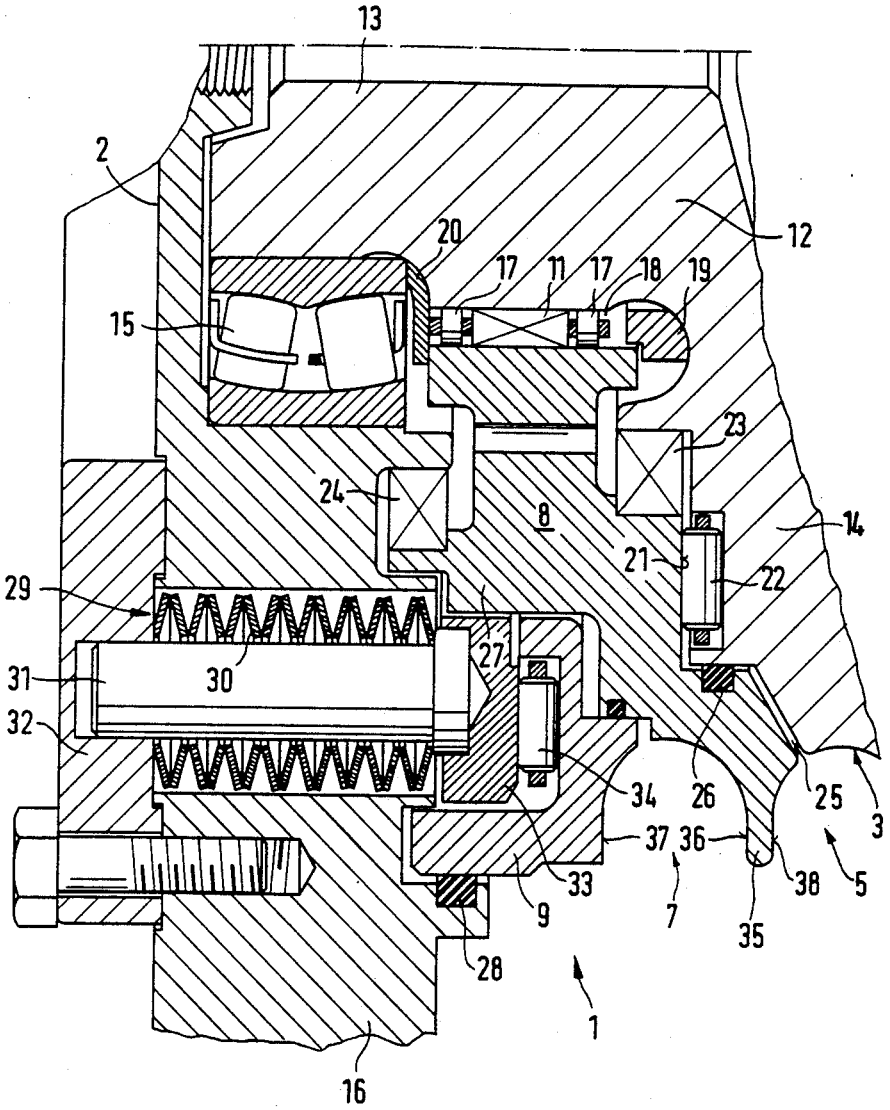
FIG. 4 is an enlarged view in the region of the run-out groove of a rope drum of the winch of FIGS. 3 and 5.
Figure 5:
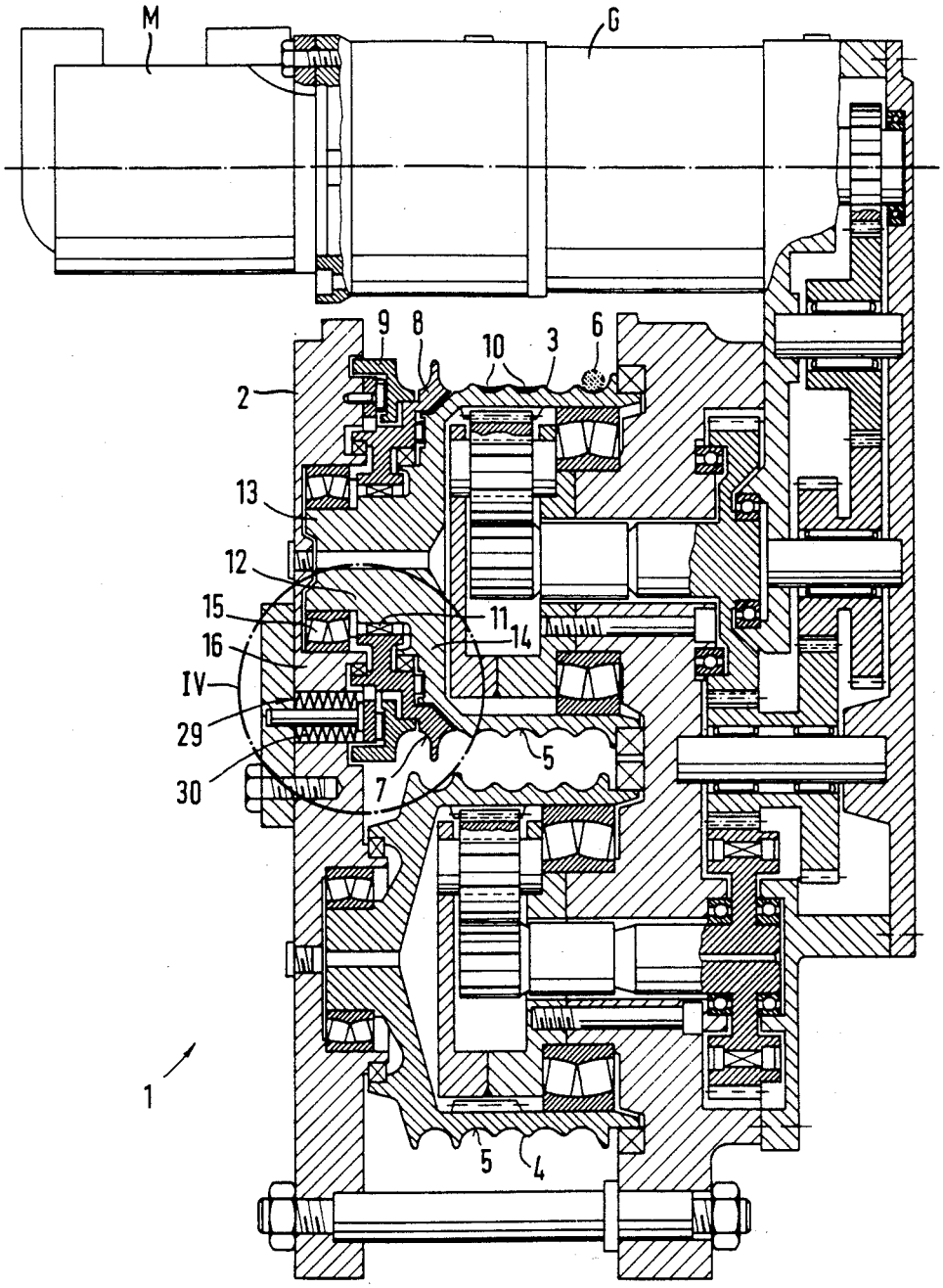
FIG. 5 is a horizontal section view taken through the winch of FIG. 1.

FIG. 4 shows that the axial projection 12 with the free runner 11 disposed thereon and the drive disc 8 mounted on the free runner 11 is arranged in the region between an axial bearing support 13 and an end wall 14 of the rope drum 3. A self-aligning bearing 15 is mounted on the bearing support 13 by means of which the rope drum 3 is journalled in a housing wall 16.

The free runner 11 has a bearing 17 mounted on each side thereof and is located with these bearings 17 in an annular gap 18 located between the axial projection 12 and the drive disc 8. The annular gap 18 is bounded on the side facing toward end wall 14 by a spacer ring 19. A disc 20 is located on the side of the annular gap 18 opposite to self-aligning bearing 15.

Further, between an end face 21 of the drive disc 8 and the end wall 14 of the rope drum 3, a bearing 22 is mounted and is configured as a needle thrust bearing. In addition, two radial sealing rings 23, 24 are provided of which one radial sealing ring 23 is journalled under the bearing 22 also between the end wall 14 of the drum 3 and the end face 21 of the drive disc 8 whereas, the other radial sealing ring 24 is located on the opposite side between the drive disc 8 and the housing wall 16. A sealing ring 26 is journalled above the bearing 22 in a separation gap 25 near the peripheral groove 5 between the end wall 14 and the end face 21 so that the bearing 22 is shielded from the outside against dirt.

The axially displaceable tightening disc 9 is journalled on a collar 27 formed on the drive disc 8. On the outside between the tightening disc 9 and the housing wall 16, a further sealing ring 28 is provided to prevent the ingress of dirt.

The tightening disc 9 is pressed in a direction against the rope 6 by means of the force of a spring-loaded biasing unit 29. The spring-loaded biasing unit 29 includes multi-layered saucer springs 30 through which a pin 31 passes. The pin 31 is journalled in an annular disc 32 which is fixedly attached outside on the housing wall 16. The pin 31 presses against a pressure disc 33 which, in turn, acts against the needle bearing 34 which is journalled in a recess of the tightening disc 9 between the latter and the pressure disc 33.

The pressure disc 8 includes a peripheral projection 35 which has a concave lateral surface 36 defining a portion of the run-out groove 7. The tightening disc 9 has a likewise concave surface portion 37 which defines a portion of the run-out groove 7. On the side lying opposite the lateral surface 36, the peripheral projection 35 has a concave surface 38 which defines in part the peripheral groove 5 of the rope drum 3 disposed next to the run-out groove 7.

The separately configured drive disc 8 and the interposition of the free runner 11 assure that the rope 6 will form no loops when pulled out also when it is dirty; instead, it will atuomatically come to a standstill if no tension force is applied forward on the rope 6 during pull-out. Also, the drive disc and free runner configuration according to the invention provide a substantially simpler solution with respect to known measures which is substantially free of maintenance and failure. It is understood that the foregoing description is that of the preferred embodiments of the invention and that various changes and modifications may be made thereto without departing from the spirit and scope of the invention as defined in the appended claims.

What is claimed is:

1. A winch comprising:

a frame housing;

at least one rope drum assembly mounted in said frame housing and including;

a rope drum rotatably mounted in said housing and defining groove means for guiding a rope thereon;

a drive disc disposed adjacent said rope drum and defining a run-out groove for the rope;

bearing means for rotatably journalling said drive disc on said rope drum so as to cause said drive disc and said rope drum to conjointly define an interface region therebetween;

free runner means for establishing an operative connection between said drive disc and said rope when the rope is pulled out under load from said run-out groove and for interrupting said operative connection when the rope becomes unloaded, said free runner means being a free runner assembly including a free runner disposed in said interface region for developing a frictive engaging force between said drive disc and said rope drum in response to an adequate tension applied to the rope so as to cause said drive disc to rotate with said rope drum for running out the rope; and, tightening means for pressing against the rope as it is run out from said run-out groove.

2. A winch comprising:

a frame housing;

at least one rope drum assembly mounted in said frame housing and including:

a rope drum rotatably mounted in said housing and defining groove means for guiding a rope thereon, said rope drum having an axial shoulder formed thereon;

a drive disc rotatably journalled on said rope drum and defining a run-out groove for the rope;

free runner means for establishing an operative connection between said drive disc and said rope drum when the rope is pulled out under load from said run-out groove and for interrupting said operative connection when the rope becomes unloaded, said free runner means being a free runner assembly including a free runner disposed between said drive disc and said mounting shoulder for developing a frictive engaging force between said drive disc and said rope drum in response to an adequate tension applied to the rope so as to cause said drive disc to rotate with the rope drum for running out the rope; and, tightening means for pressing against the rope as it is run out from said run-out groove.

3. The winch of claim 2, said tightening means comprising a tightening disc mounted on said frame housing and bounding said run-out groove; and, biasing means for biasing said tightening disc against the rope.

4. The winch of claim 3, said rope drum having an end wall extending radially outwardly from said axial mounting shoulder; said axial mounting shoulder having a bearing support for said rope drum extending therefrom and said mounting shoulder being disposed between said end wall and said bearing support.

5. The winch of claim 4, said free runner assembly including two end bearings disposed on respective lateral sides of said free runner, said drive disc and said mounting shoulder conjointly defining a gap therebetween for accommodating said end bearings and said free runner therein; and, said winch further comprising a spacer ring bounding said gap on the side thereof facing said end wall of said rope drum; a self-aligning bearing disposed between said housing and said bearing support for supporting said rope drum on said housing; and, a disc bounding said gap on the side thereof facing toward said self-aligning bearing.

6. The winch of claim 5, said drive disc having an end face facing said end wall of said rope drum; and, said winch further comprising bearing means disposed between said end face of said drive disc and said end wall of said rope drum.

7. The winch of claim 6, said housing having a wall adjacent said drive disc, said winch further comprising a first radial seal disposed between said last-mentioned wall and said drive disc; and, a second radial seal disposed between said end face of said drive disc and said end wall of said rope drum.

8. The winch of claim 7, said groove means including a groove next to said run-out groove, said winch further comprising a sealing ring disposed near said groove of said groove means and between said end face of said drive disc and said end wall of said rope drum, said bearing means being mounted in the region between said last-mentioned sealing ring and said second radial seal.

9. The winch of claim 3, said drive disc having a shoulder formed thereon, said tightening disc being mounted on said last-mentioned shoulder so as to be displaceable against the rope, said biasing means comprising spring means mounted in said housing for resiliently biasing said tightening disc against said rope.

10. The winch of claim 9, said biasing means comprising a press disc for pressing said tightening disc toward the rope, and a pin spring-loaded by said spring means for pressing said press disc against said tightening disc; and, needle bearing means disposed between said press disc and said tightening disc.

11. The winch of claim 8, said drive disc having a peripheral projection having a first lateral wall surface defining a portion of said groove next to said run-out groove and having a second lateral wall surface defining a portion of said run-out groove.

* * * * *

UNITED STATES PATENT AND TRADEMARK OFFICE

CERTIFICATE OF CORRECTION

PATENT NO. : 4,632,363

DATED : December 30, 1986

INVENTOR(S) : Egon Frommherz

It is certified that error appears in the above-identified patent and that said Letters Patent is hereby corrected as shown below:

In column 2, line 33: delete "mecnanically" and substitute -- mechanically -- therefor.

In column 2, line 65: delete "Clutch"." and substitute -- Clutch" having serial no. 762,106 and filed on August 2, 1985. -- therefor.

In column 4, line 2: delete "atuomatically" and substitute -- automatically -- therefor.

In column 4, line 17: delete "including;" and substitute -- including: -- therefor.

Signed and Sealed this

Twenty-second Day of September, 1987

*Attest:*

DONALD J. QUIGG

*Attesting Officer* *Commissioner of Patents and Trademarks*